United States Patent [19]

Pávek et al.

[11] 4,347,649

[45] * Sep. 7, 1982

[54] NOZZLE FOR TEXTURING THREAD

[75] Inventors: Miloslav Pávek; Miroslav Nováček; Jiří Fantl, all of Liberec; Jan Kára, Prague; Zdeněk Kašpárek, Liberec, all of Czechoslovakia

[73] Assignee: Elitex, koncern textilniho strojirenstvi, Liberec, Czechoslovakia

[ * ] Notice: The portion of the term of this patent subsequent to Jul. 29, 1997, has been disclaimed.

[21] Appl. No.: 163,425

[22] Filed: Jun. 27, 1980

[30] Foreign Application Priority Data

Jun. 27, 1979 [CS] Czechoslovakia ..... 4420-79

[51] Int. Cl.[3] ..... D02G 1/16

[52] U.S. Cl. ..... 28/254

[58] Field of Search ..... 28/254, 271, 274

[56] References Cited

U.S. PATENT DOCUMENTS

| | | | |
|---|---|---|---|
| 2,938,257 | 5/1960 | Bauer | 28/271 X |
| 3,978,558 | 9/1976 | Pike | 28/274 |
| 3,983,609 | 10/1976 | Pike | 28/274 |
| 4,097,975 | 7/1978 | Moeller | 28/254 |
| 4,188,692 | 2/1980 | Pike | 28/271 |
| 4,214,352 | 7/1980 | Pavek et al. | 28/254 |

*Primary Examiner*—Robert Mackey

[57] ABSTRACT

The present invention relates to a nozzle for texturing a thread by a gaseous fluid flow. The nozzle is provided with an angular channel for guiding a thread, a channel for feeding gaseous fluid thereto, opening obliquely into the angular channel, and at the exit of the angular channel is located a texturing bridge. A second channel for guiding a second thread is provided, which opens obliquely into the angular channel for guiding the first thread.

4 Claims, 4 Drawing Figures

NOZZLE FOR TEXTURING THREAD

BACKGROUND OF THE INVENTION

The present invention relates to a nozzle for texturing thread by means of a gaseous fluid jet, which permits new effects to be obtained in textured yarn and which can be produced easily.

At present, many different types of nozzles for texturing thread are known. One example of the known nozzles has three channels for feeding gaseous fluid, with the channels opening into the channel for guiding the thread. The openings of the channels for feeding gaseous fluid into the channel for guiding the thread are selected so that the flowing gaseous fluid untwists the thread and projects it against a texturing bridge which is situated either in the channel for guiding thread or opposite to the channel.

However, the known nozzles for texturing thread have serious disadvantages, in spite of giving good results in texturing. The main disadvantage is that only pre-twisted thread can be textured by the nozzle, and the nozzle can be used only for a certain denier range of the thread and for one twist type, such as an S-twist. For another twist-type, or another denier value, it is necessary to use a nozzle which is appropriately modified to handle these parameters.

Further disadvantages of the known nozzles are their short service life, due to abrasion of the nozzle, by the thread, and also they are very difficult to reproduce, as it is extremely difficult to make two nozzles which will give the same results. This last disadvantage is partially overcome by an adjustable nozzle for texturing thread, in which it is possible to change the position of the channel opening for feeding the gaseous fluid relative to the channel for guiding the thread. The adjustment of a plurality of nozzles in the machine is, however, very time consuming and, moreover, there is the danger that by the intervention of a machine operator an imbalance in the machine might be created.

Another example of the known nozzles for texturing thread by a gaseous fluid flow has an angular channel for guiding the thread, and a texturing bridge located at its orifice. The disadvantage of this nozzle type is that only one thread can be processed therein, making it impossible to produce fancy yarn.

SUMMARY OF THE INVENTION

The disadvantages of the known texturing nozzles are mitigated, or completely removed, by the nozzle according to the present invention, which has a second channel for guiding a second thread and is obliquely opened into the channel for guiding the first thread.

An advantage of the nozzle for texturing thread by a gaseous fluid flow according to the present invention consists in that new effects can be obtained in textured yarns. It is also advantageous in that the nozzle according to the present invention can be produced very easily.

The texturing nozzel comprises a nozzle body, a nozzle lid mounted to the nozzle body, a first blending channel for guiding a first thread, a second channel for guiding a second thread, and a third channel for feeding gaseous fluid, opening obliquely into the first blending channel. The blending channel has an angular cross section to prevent a rotary motion by the threads.

A texturing bridge is located at the exit of the first blending channel with the texturing bridge being formed by an opening in the nozzle lid.

DESCRIPTION OF THE DRAWINGS

Examples of the embodiments of the invention are shown in the drawings, wherein.

PREFERRED EMBODIMENT

Figure 1:
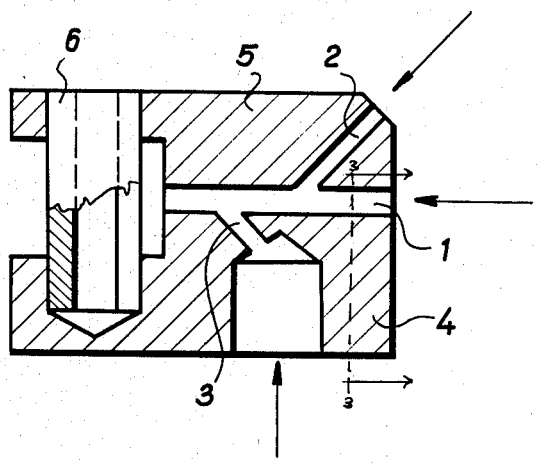
FIG. 1 is a front view of a first embodiment of the nozzle in partial section.
Figure 2:
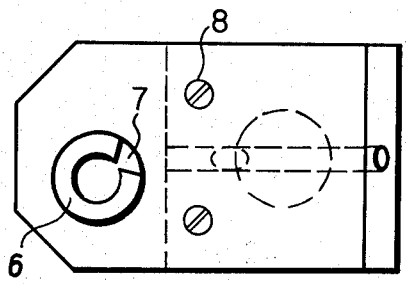
FIG. 2 is a plan view of the nozzle as shown in FIG. 1.

The embodiment of the texturing nozzle, as shown in FIG. 1, is provided with a nozzle body 4, a nozzle lid 5 detachably mounted on nozzle body 4 and secured thereto by screws 8, a first angular blending channel 1 for guiding a first thread, which has a rectangular cross-section, formed by a groove in the nozzle body 4, and closed from above by nozzle lid 5, a second channel 2 for guiding a second thread located in the nozzle lid 5 and opening obliquely into the first angular blending channel 1, a third channel 3 for feeding gaseous fluid, located in the nozzle body 4 and also opening obliquely into the first angular blending channel 1. A texturing bridge 6 is located at the exit of the first blending channel 1 and is formed by an opening in nozzle lid 5 and nozzle body 4. The texturing bridge 6 has a wedge-shaped recess along its longitudinal axis which is directed towards the exit to the first blending channel 1, and the entry slot 7 into the texturing bridge 6 is skewed relative to the longitudinal axis of the first blending channel 1 as shown in FIG. 2.

Figure 3:
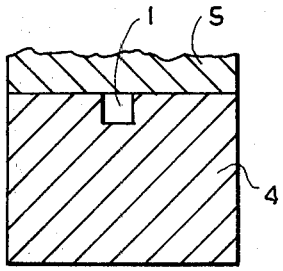
FIG. 3 is a partial section along plane 3—3 in FIG. 1.

In the nozzle according to the present invention, a first thread enter the first channel 1 while a second thread is fed into the first channel 1 through the second channel 2. In the embodiment of FIGS. 1, 2 and 3, the first channel 1 is formed as a groove in body 4, the bottom surface of lid 5 being flat. In the first channel 1, both threads are acted upon by a gaseous fluid flow, fed through a third channel 3. The threads are opened by the flowing gaseous fluid and the separate fibers are projected in this condition, against the working surface of the texturing bridge, on which looping and interlacing of separate fibers is performed. Thus, the threads are shortened by simultaneously increasing their volume, with the amount of shortening being determined by the ratio of feeding and withdrawing speeds of the threads.

The feeding speed of at least one thread can be arbitrarily changed in the course of texturing, thus making it possible to achieve the desired effects in the resulting composite thread. The resulting composite thread is then withdrawn to a winding device.

Figure 4:
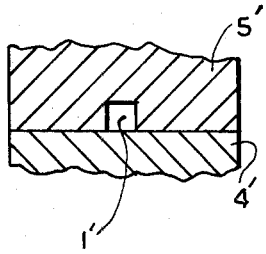
FIG. 4 is a partial section, similar to FIG. 3, of a second embodiment of the nozzle of the invention.

In a second embodiment of the invention, shown in FIG. 4, the first angular blending channel 1' is formed by a groove in nozzle lid 5', with the flat upper surface of nozzle body 4', forming the bottom of the first blending channel 1'.

Although the invention is illustrated and described with reference to a plurality of preferred embodiments thereof, it is expressly understood that it is in no way limited to the disclosure of such a plurality of preferred embodiments, but is capable of numerous modifications within the scope of the appended claims.

We claim:

1. A nozzle for combining two threads and texturing the resultant composite thread by a gaseous fluid flow, comprising a nozzle body, a nozzle lid mounted on the nozzle body, a first angular channel for guiding a first thread, a second channel for guiding a second thread opening obliquely into the first channel, a third channel for feeding gaseous fluid opening obliquely into and intersecting the first channel downstream of the intersection of the first and second channels, a texturing bridge located at the exit of the first channel formed by a hollow tube having an axis skewed relative to the longitudinal axis of the first channel, the tube having an open end and a side wall which is provided with a longitudinal wedge-shaped opening, disposed opposite the exit opening of the first channel, the longitudinal opening extending through the side wall of the tube to the hollow interior thereof being directed angularly toward and intersecting the longitudinal axis of the first channel, whereby a first thread is fed into the first channel, a second thread is fed through the second channel into the first channel where it combines with the first thread and the composite thread is met by the gaseous fluid from the third channel and projected against the texturing bridge and the resulting composite textured thread is then withdrawn through the opened end of the texturing bridge.

2. A nozzle as claimed in claim 1, wherein the nozzle lid is detachably mounted on the nozzle body.

3. A nozzle as claimed in claim 1, wherein the first angular channel for guiding the first thread is formed by a groove in the nozzle body and closed from above by the nozzle lid.

4. A nozzle as claimed in claim 1, wherein the second channel for guiding the second thread is formed by a groove in the nozzle lid and closed from below by the nozzle body.

* * * * *